US008931883B2

(12) United States Patent
Shiiya

(10) Patent No.: US 8,931,883 B2
(45) Date of Patent: Jan. 13, 2015

(54) HEAD MOVING MECHANISM AND PRINTING APPARATUS

(71) Applicant: Seiko Epson Corporation, Tokyo (JP)

(72) Inventor: Tomoyuki Shiiya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/858,471

(22) Filed: Apr. 8, 2013

(65) Prior Publication Data

US 2013/0286093 A1 Oct. 31, 2013

(30) Foreign Application Priority Data

Apr. 26, 2012 (JP) ..... 2012-100983

(51) Int. Cl.

| | |
|---|---|
| ***B41J 23/00*** | (2006.01) |
| ***B41J 23/12*** | (2006.01) |
| ***B41J 25/34*** | (2006.01) |
| *B41J 25/00* | (2006.01) |

(52) U.S. Cl.

CPC *B41J 23/12* (2013.01); *B41J 25/34* (2013.01); *B41J 2025/008* (2013.01)

USPC ..... 347/37; 347/32

(58) Field of Classification Search

USPC ..... 347/32, 37

See application file for complete search history.

(56) References Cited

U.S. PATENT DOCUMENTS

| | | | | |
|---|---|---|---|---|
| 6,398,338 | B1 * | 6/2002 | Berg et al. | 347/32 |
| 2004/0080563 | A1 * | 4/2004 | Leemhuis | 347/22 |
| 2012/0075382 | A1 * | 3/2012 | Kachi | 347/37 |

FOREIGN PATENT DOCUMENTS

JP 2011-067964 A 4/2011

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A head driving mechanism includes a first cam follower an end portion of which is attached to a first holding unit and the other end portion of which includes a first sliding-contact surface disposed in sliding contact with a cam, and a second cam follower an end portion of which is attached to the second holding unit and the other end portion of which includes a second sliding-contact surface disposed in sliding contact with the cam. The first cam follower and the second cam follower are each displaced by rotation of the cam so as to move the first printing head and the second printing head, while the first sliding-contact surface and the second sliding-contact surface are in sliding contact with an outer circumferential surface of the cam.

10 Claims, 6 Drawing Sheets

HEAD MOVING MECHANISM AND PRINTING APPARATUS

CROSS-REFERENCE TO RELATED APPLICATIONS

The entire disclosure of Japanese Patent Application No. 2012-100983, filed Apr. 26, 2012 is expressly incorporated by reference herein.

BACKGROUND

1. Technical Field

The present invention relates to a head driving mechanism that drives a plurality of printing heads, and a printing apparatus including the head driving mechanism.

2. Related Art

JP-A-2011-67964 (in particular, see FIG. 1) discloses a printing apparatus that dispenses a liquid such as ink or recording fluid from a plurality of printing heads onto a recording medium such as a film, to thereby record color images. In this apparatus, the recording medium is wound, with a predetermined tension applied thereto, around a circular column-shaped platen drum the recording medium, and supported on the curved surface of the platen drum. The plurality of printing heads are provided around the circumferential surface of the platen drum.

To record high-quality images, it is essential that a paper gap, in other words a distance between a nozzle tip (outlet of the ink) of the printing head and the recording medium is maintained at a proper value, and hence the printing heads have to be moved according to the thickness of the recording medium, to thereby locate the printing heads at a proper distance from the platen drum with high accuracy. However, no specific reference is made in JP-A-2011-67964 about such a positioning method.

According to JP-A-2011-67964, in addition, the printing heads are radially arranged with respect to the rotation axis of the platen drum, so that, with respect to the landing position of the ink, the printing heads of the respective colors are oriented perpendicular to the curved surface of the platen drum. Accordingly, on the assumption that one of the printing heads is set to move in a first direction, another printing head has to be moved in a second direction which is inclined with respect to the first direction, and thus the printing heads have to be moved in different directions. Therefore, many of the printing apparatuses of such a type include head driving mechanisms provided for the respective printing heads, for moving the printing heads in a direction perpendicular to the curved surface of the platen drum.

However, providing the same number of head driving mechanisms as that of the printing heads not only constitutes a major factor that increases the size and cost of the printing apparatus, but also makes it difficult to locate the printing heads at the correct position with high accuracy, because of individual variation among the head driving mechanisms.

SUMMARY

An advantage of some aspects of the present invention is provision of a small-sized head driving mechanism that can be manufactured at a lower cost, the head driving unit being capable of moving a first printing head in a first direction and a second printing head in a second direction different from the first direction, and a printing apparatus that includes such a head driving mechanism.

In an aspect, the present invention provides a head driving mechanism including a first holding unit that holds a first printing head so as to move in a first direction, a second holding unit that holds a second printing head so as to move in a second direction inclined with respect to a first direction, a rotary actuator that generates rotative driving force for driving the first printing head and the second printing head, a cam shaft to be driven to rotate by the rotative driving force from the rotary actuator, a cam attached to the cam shaft, a first cam follower an end portion of which is attached to the first holding unit and the other end portion of which includes a first sliding-contact surface disposed in sliding contact with the cam, and a second cam follower an end portion of which is attached to the second holding unit and the other end portion of which includes a second sliding-contact surface disposed in sliding contact with the cam. The first cam follower and the second cam follower are each displaced by rotation of the cam so as to move the first printing head and the second printing head, while the first sliding-contact surface and the second sliding-contact surface are in sliding contact with an outer circumferential surface of the cam.

In another aspect, the present invention provides a printing apparatus including a rotatable roller, a first printing head that dispenses a first liquid in a first direction onto a recording medium wound around a surface of the roller, a second printing head that dispenses a second liquid in a second direction inclined with respect to the first direction onto the recording medium wound around the surface of the roller, and a head driving mechanism that drives the first printing head and the second printing head. The head driving mechanism includes a first holding unit that holds the first printing head so as to move in the first direction, a second holding unit that holds the second printing head so as to move in the second direction, a rotary actuator that generates rotative driving force for driving the first printing head and the second printing head, a cam shaft driven to rotate by the rotative driving force from the rotary actuator, a cam attached to the cam shaft, a first cam follower an end portion of which is attached to the first holding unit and the other end portion of which includes a first sliding-contact surface disposed in sliding contact with the cam, and a second cam follower an end portion of which is attached to the second holding unit and the other end portion of which includes a second sliding-contact surface disposed in sliding contact with the cam. The first cam follower and the second cam follower are each displaced by rotation of the cam so as to move the first printing head and the second printing head, while the first sliding-contact surface and the second sliding-contact surface are located adjacent to each other and simultaneously in sliding contact with an outer circumferential surface of the cam.

While the first printing head is movable in the first direction, the second printing head is movable in the second direction. To drive a plurality of printing heads set to move in different directions, generally, head driving mechanisms are provided for the respective printing heads. In addition, a cam mechanism is widely employed for driving the printing heads. According to the present invention, in contrast, a single head driving mechanism drives the plurality of printing heads each set to move in different directions. Such a configuration contributes to reducing the size and the manufacturing cost of the printing apparatus, compared with the configuration in which the head driving mechanisms are provided for the respective printing heads.

Further, in the case of driving the printing head by using the cam, providing the head driving mechanisms for the respective printing heads incurs a positioning error among the printing heads, originating from individual variation among the cams of the head driving mechanisms, which leads to degradation in printing accuracy. According to the present invention, in contrast, a single cam is utilized in common by the plurality of printing heads. Therefore, the plurality of printing heads can be properly positioned free from the influence of the individual variation among the cams, and a highly accurate printing result can be obtained.

In the foregoing printing apparatus, the first direction and the second direction may be set to radially extend from the rotation axis of the roller. In this case, the first direction becomes perpendicular to the roller surface, at the position where the first liquid dispensed from the first printing head lands on the recording medium. Likewise, the second direction becomes perpendicular to the roller surface, at the position where the second liquid dispensed from the second printing head lands on the recording medium. These printing heads are positioned by a single cam, so that the paper gap, i.e., the distance between the printing head and the recording medium is adjusted. Such a configuration prevents the paper gap from being adjusted to different values among the printing heads, and thereby provides a highly accurate printing result.

In the foregoing head driving mechanism, the first sliding-contact surface and the second sliding-contact surface may be oriented downward in the vertical direction, and in contact with the outer circumferential surface of the cam. In this case, the self-weight of the first cam follower and the components connected thereto assures that the first sliding-contact surface makes contact with the outer circumferential surface of the cam. Likewise, the self-weight of the second cam follower and the components connected thereto assures that the second sliding-contact surface makes contact with the outer circumferential surface of the cam. Such a configuration eliminates the need to provide an additional mechanism to assure that the sliding-contact surfaces make contact with the outer circumferential surface of the cam.

The outer circumferential surface of the cam may include a first adjustment region that varies a distance between the cam shaft and the outer circumferential surface in a first variation pattern, and a second adjustment region that varies the distance between the cam shaft and the outer circumferential surface in a second variation pattern, the second adjustment region continuously extending from the first adjustment region, so that the first printing head and the second printing head are positioned in a vertical direction on the basis of the first variation pattern, while the first sliding-contact surface and the second sliding-contact surface are in sliding contact with the first adjustment region to rotate the cam, and that the first printing head and the second printing head are positioned in a vertical direction on the basis of the second variation pattern, while the first sliding-contact surface and the second sliding-contact surface are in sliding contact with the second adjustment region to rotate the cam. Preparing thus the two types of variation patterns in advance improves the versatility of the head driving mechanism. For example, as will be described in details regarding an embodiment, the plurality of printing heads can be moved in suitable variation patterns for a printing job and a capping operation respectively, and thus the printing job and the capping operation can be optimized.

The head driving mechanism may further include a first engaging portion provided on the other end portion of the first cam follower, a second engaging portion provided on the other end portion of the second cam follower, a first restriction member having an end portion attached to the cam shaft or the cam to rotate with the cam in an interlocked manner and the other end portion to be located above the second adjustment region in the vertical direction so as to hold the first engaging portion between the second adjustment region and the first restriction member to restrict the first cam follower from moving in the vertical direction, while the second adjustment region of the cam is in sliding contact with the first sliding-contact surface, and a second restriction member having an end portion attached to the cam shaft or the cam to rotate with the cam in an interlocked manner and the other end portion to be located above the second adjustment region in the vertical direction so as to hold the second engaging portion between the second adjustment region and the second restriction member to restrict the second cam follower from moving in the vertical direction, while the second adjustment region of the cam is in sliding contact with the second sliding-contact surface. Such a configuration allows, as will be described regarding an embodiment, the printing heads to move in a desired direction by using the rotation of the cam, even when the printing heads are subjected to a stress in a direction opposite to the moving direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
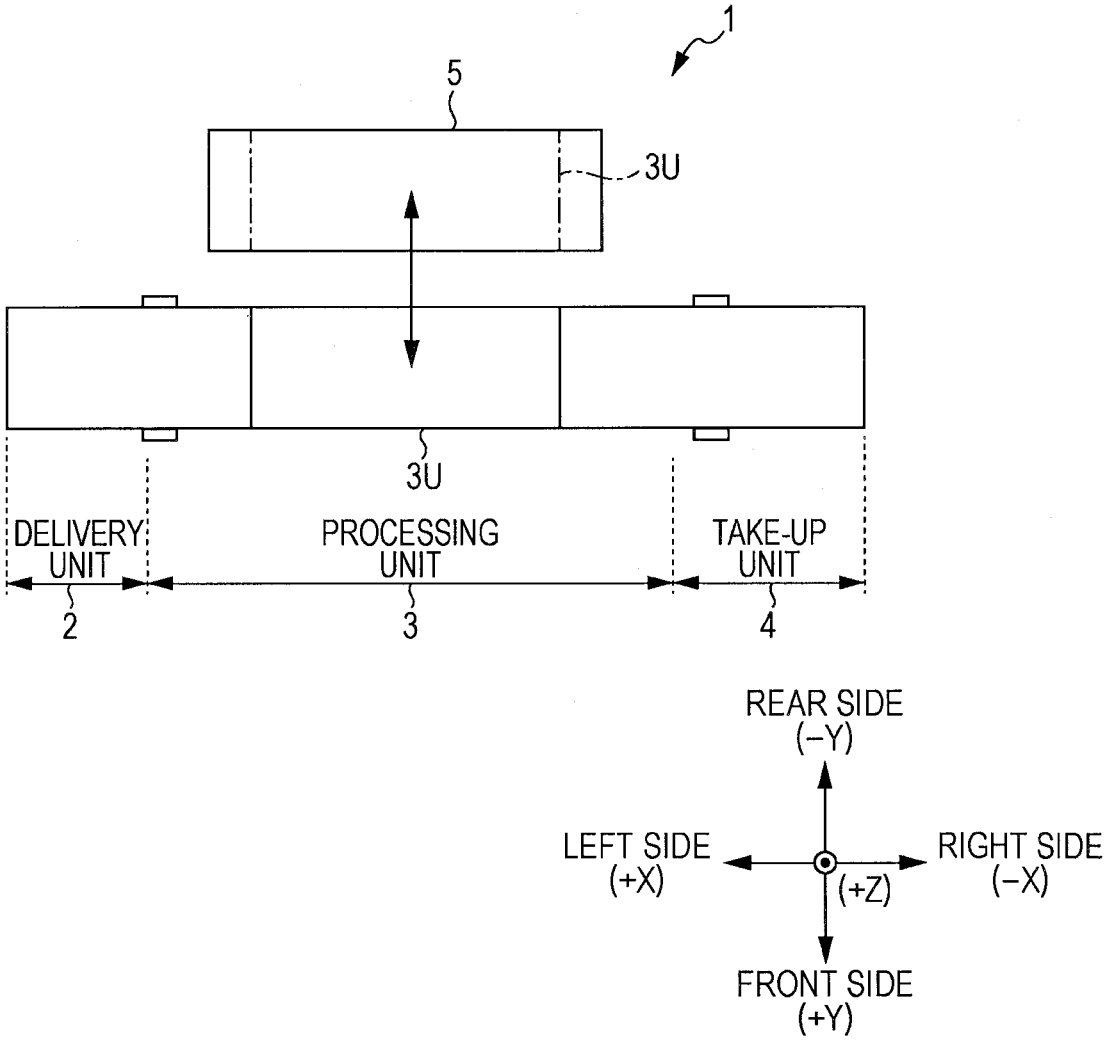
FIG. 1 is a schematic plan view showing a layout of a printing apparatus including a head driving mechanism according to an embodiment of the present invention.
Figure 2:
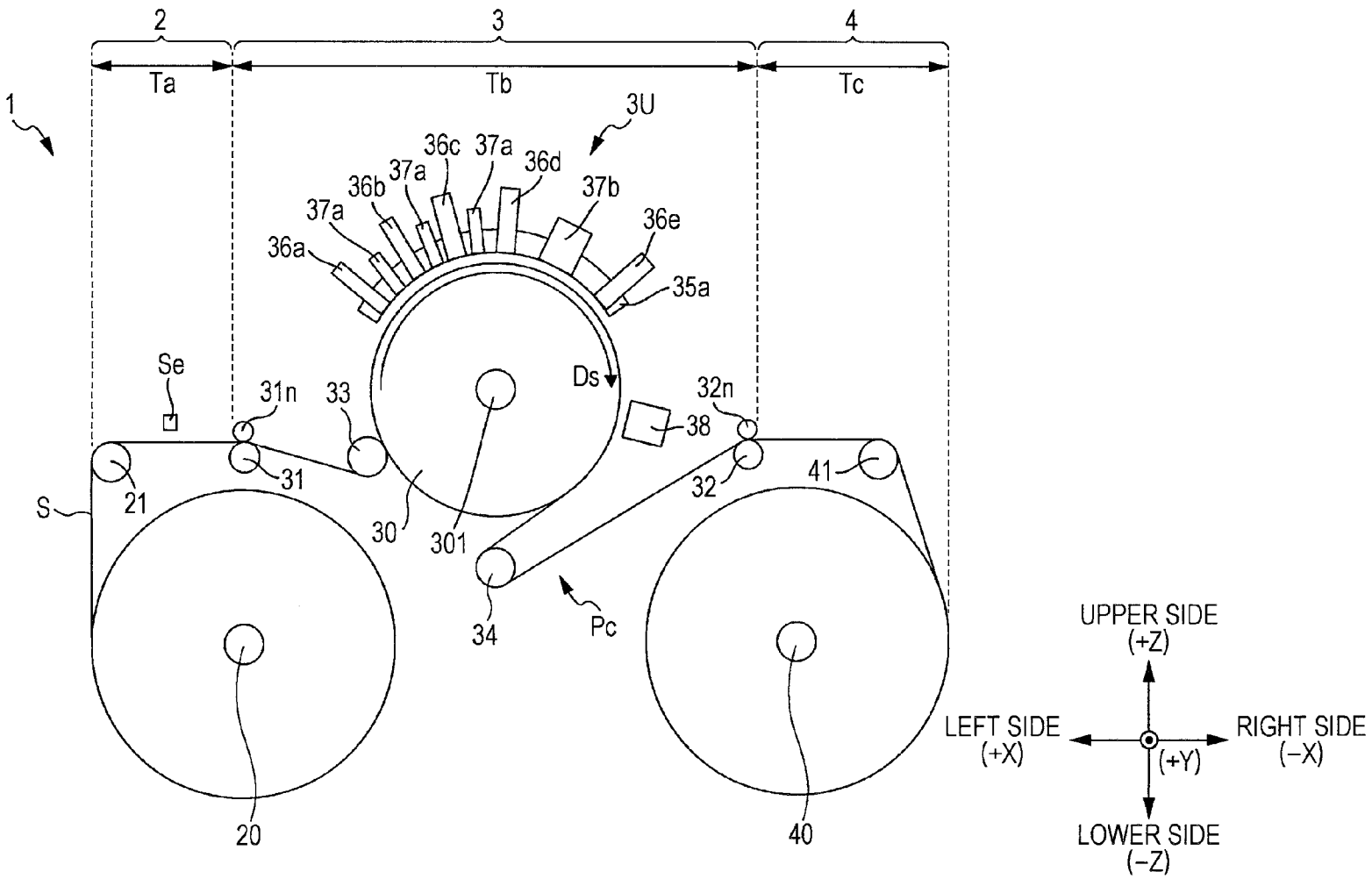
FIG. 2 is a schematic front view of the printing apparatus shown in FIG. 1.

FIG. 1 is a schematic plan view showing a layout of a printing apparatus including a head driving mechanism according to an embodiment of the present invention. FIG. 2 is a schematic front view of the printing apparatus shown in FIG. 1. The printing apparatus 1 includes a delivery unit 2, processing unit 3, and a take-up unit 4 aligned in a left-right direction on the front side of the apparatus, and a maintenance unit 5 located on the rear side of the processing unit 3, which includes a processor 3U set to move interlocked with the processing unit 3, with respect to the maintenance unit 5. In these drawings, as well as in the drawings to be referred to later, a three-dimensional coordinate system is adapted, in which the axes respectively correspond to the left-right direction X, a front-back direction Y, and a vertical direction Z of the printing apparatus 1.

As shown in FIG. 2, in the printing apparatus 1 the delivery unit 2 and the take-up unit 4 include a delivery shaft 20 and a take-up shaft 40, respectively. The sheet S (web) is spanned between the delivery unit 2 and the take-up unit 4, with end portions respectively wound in a roll around the delivery shaft 20 and the take-up shaft 40. The sheet S is transported from the delivery shaft 20 to the processing unit 3 along the route Pc spanned as above, and then to the take-up shaft 40 after undergoing the printing operation by the processor 3U. The types of the sheet S, exemplifying the recording medium according to the present invention, may be broadly classified into paper sheets and film sheets. Examples of the paper sheets include wood-free paper, cast-coated paper, art paper, and coated paper. Examples of the film sheets include polyethylene terephthalate (PET) and polypropylene (PP). In the description given below, a surface of the sheet S on which images are recorded will be referred to as front surface, and the surface opposite to the front surface will be referred to as back surface.

The delivery unit 2 includes the delivery shaft 20 on which the end portion of the sheet S is wound, and a slave roller 21 with which the sheet S drawn out from the delivery shaft 20 is engaged. The sheet S is supported by the delivery shaft 20, with the front surface oriented outward. When the delivery shaft 20 rotates clockwise in FIG. 2, the sheet S wound around the delivery shaft 20 is delivered to the processing unit 3 through the slave roller 21. Here, the sheet S is wound on the delivery shaft 20 by means of a core shaft (not shown) removably attached to the delivery shaft 20. Accordingly, when the sheet S on the delivery shaft 20 is used up, the sheet S can be replaced by attaching a new core shaft having the sheet S wound thereon in a roll to the delivery shaft 20. A code Se in FIG. 2 denotes an edge sensor that detects the edges of the sheet S in the width direction, between the slave roller 21 and a front driving roller 31.

The processing unit 3 supports the sheet S delivered from the delivery unit 2 on the platen drum 30, and causes the processor 3U disposed along an outer circumferential surface of the platen drum 30 to perform a predetermined operation for printing images on the sheet S. The processing unit 3 includes the front driving roller 31 and a rear driving roller 32 on the respective sides of the platen drum 30, and the sheet S transported from the front driving roller 31 to the rear driving roller 32 is supported by the platen drum 30 and undergoes the printing process.

The front driving roller 31 includes a plurality of minute projections formed by thermal spraying on the outer circumferential surface, on which the back surface of the sheet S delivered from the delivery unit 2 is engaged. When the front driving roller 31 rotates clockwise in FIG. 2, the sheet S delivered from the delivery unit 2 is transported to the downstream side of the transport route. The front driving roller 31 is provided with a nip roller 31*n*. The nip roller 31*n* is biased toward the front driving roller 31 and in contact with the front surface of the sheet S, to pinch the sheet S in collaboration with the front driving roller 31. Such a configuration secures frictional force between the front driving roller 31 and the sheet S, thereby assuring the transport of the sheet S with the front driving roller 31.

The platen drum 30 is a cylindrical drum supported by a supporting mechanism (not shown) so as to rotate about a rotation shaft 301 extending in the Y-direction, and the back surface of the sheet S transported from the front driving roller 31 to the rear driving roller 32 is engaged with the platen drum 30. The platen drum 30 supports the sheet S from the side of the back surface, while being made to rotate by frictional force with sheet S in the transport direction Ds thereof. Here, the processing unit 3 includes slave rollers 33, 34 that serve to fold back the sheet S on the respective sides of the portion thereof engaged with the platen drum 30. The slave roller 33 is engaged with the front surface of the sheet S between the front driving roller 31 and the platen drum 30, to fold back the sheet S. Likewise, the slave roller 34 is engaged with the front surface of the sheet S between the platen drum 30 and the rear driving roller 32, to fold back the sheet S. Folding back the sheet S as above both upstream and downstream of the platen drum 30 in the transport direction Ds allows a longer engaging portion between the sheet S and the platen drum 30 to be secured.

The rear driving roller 32 includes a plurality of minute projections formed by thermal spraying on the outer circumferential surface, on which the back surface of the sheet S transported from the platen drum 30 through the slave roller 34 is engaged. When the rear driving roller 32 rotates clockwise in FIG. 2, the sheet S is transported toward the take-up unit 4. The rear driving roller 32 is provided with a nip roller 32*n*. The nip roller 32*n* is biased toward the rear driving roller 32 and in contact with the front surface of the sheet S, to pinch the sheet S in collaboration with the rear driving roller 32. Such a configuration secures frictional force between the rear driving roller 32 and the sheet S, thereby assuring the transport of the sheet S with the rear driving roller 32.

The sheet S thus transported from the front driving roller 31 to the rear driving roller 32 is supported by the outer circumferential surface of the platen drum 30. The processing unit 3 includes the processor 3U that prints color images on the front surface of the sheet S supported by the platen drum 30. The processor 3U includes a front plate 35*a* and a rear plate 35*b* (see FIG. 3) that constitute a pair in the front-back direction. The plates 35*a*, 35*b* each have an arcuate shape along the outer circumferential surface of the platen drum 30, and are connected to each other by a joint member (not shown) so as to form a unit frame. To the unit frame, constituents of the processor 3U (printing heads 36*a* to 36*e*, UV lamps 37*a*, 37*b*, and head driving mechanisms) are attached as will be described later.

Four printing heads 36*a* to 36*d* respectively corresponding to yellow, cyan, magenta, and black ink are aligned in this order in the transport direction Ds. In other words, the four printing heads 36*a* to 36*d* are radially disposed about the rotation shaft 301 of the platen drum 30. Out of the printing heads 36*a* to 36*d*, two upstream printing heads 36*a* and 36*b* in the transport direction Ds are moved and positioned with respect to the sheet S wound on the platen drum 30, by a single head driving mechanism. Likewise, the remaining printing heads 36*a*, 36*b* on the downstream side are moved and positioned with respect to the sheet S wound on the platen drum 30, by another head driving mechanism. With the two head driving mechanisms that move the four printing heads 36*a* to 36*d* to predetermined positions, a distance between the nozzle tip (outlet of the ink) of the printing heads 36*a* to 36*d* and the sheet S, i.e., the paper gap, can be adjusted to a proper value. When the printing heads 36*a* to 36*d* dispense the ink onto the sheet S wound on the outer circumferential surface of the platen drum 30 with the paper gap adjusted as above, a color image is formed on the front surface of the sheet S. Employing thus one head driving mechanism to move two printing heads to a proper position is one of distinctive features of the present invention, and details of the configuration and operation of the head driving mechanism will be subsequently described.

The liquid such as ink or recording fluid to be used in the printing heads 36*a* to 36*d* can be typically exemplified by ultraviolet (UV) ink (photocurable ink) that is cured when irradiated with ultraviolet ray (light). Accordingly, the processor 3U includes UV lamps 37*a*, 37*b* (light emitting units) that cures and fixes the ink on the sheet S. The curing of the ink is performed in two stages, namely tentative curing and complete curing. The UV lamps 37*a* for tentative curing are located between the adjacent ones of the printing heads 36*a* to 36*d*. The UV lamps 37*a* emit relatively weak ultraviolet ray to cure the ink to such an extent that the shape of the ink is prevented from collapsing (tentative curing), and not to completely cure the ink. The UV lamp 37*b* for complete curing is located downstream of the printing heads 36*a* to 36*d* in the transport direction Ds. The UV lamp 37*b* emits more intense ultraviolet ray than that from the UV lamps 37*a*, to thereby completely cure the ink (complete curing). The color image formed by the printing heads 36*a* to 36*d* can be fixed to the front surface of the sheet S, by performing the tentative curing and the complete curing.

Further, a printing head 36*e* is provided downstream of the UV lamp 37*b* in the transport direction Ds. The printing head 36*e* is disposed to oppose the front surface of the sheet S wound on the platen drum 30 with a certain gap therebetween, and dispenses transparent UV ink onto the front surface of the sheet S by an ink jet method. In other words, the transparent ink is additionally dispensed onto the color image composed of the four colors by the printing heads 36*a* to 36*d*. Here, the printing head 36*e* is independently driven and positioned by another head driving mechanism than the foregoing head driving mechanisms, to set the paper gap at a proper value.

The printing heads 36*a* to 36*e*, the UV lamps 37*a*, 37*b* and the head driving mechanisms are attached to the unit frame as above, thus constituting the processor 3U. The processor 3U is located between the delivery unit 2 and the take-up unit 4 as indicated by solid lines in FIG. 1, when a normal operation, i.e., the printing operation, is performed. In contrast, the processor 3U is moved to the maintenance unit 5 by a sliding mechanism (not shown) as indicated by dash-dot lines in FIG. 1, when a maintenance operation for the processor 3U, for example wiping or capping of the printing heads 36*a* to 36*e*, is performed.

Referring again to FIG. 2, the configuration of the processing unit 3 and the take-up unit 4 will be described further. In the processing unit 3, the UV lamp 38 is provided downstream of the printing head 36*e* in the transport direction Ds. The UV lamp 38 emits intense ultraviolet ray to completely cure the transparent ink dispensed by the printing head 36*e*. Accordingly, the transparent ink can be fixed to the front surface of the sheet S.

The sheet S having the color image formed thereon by the processing unit 3 is transported by the rear driving roller 32 to the take-up unit 4. The take-up unit 4 includes, in addition to the take-up shaft 40 on which the end portion of the sheet S is wound, a slave roller 41 engaged with the back surface of the sheet S between the take-up shaft 40 and the rear driving roller 32. The take-up shaft 40 takes up the end portion of the sheet S and supports the sheet S, with the front surface oriented outward. To be more detailed, when the take-up shaft 40 rotates clockwise in FIG. 2, the sheet S transported from the rear driving roller 32 is taken up by the take-up shaft 40 through the slave roller 41. Here, the sheet S is wound on the take-up shaft 40 by means of a core shaft (not shown) removably attached to the take-up shaft 40. Accordingly, when the sheet S on the take-up shaft 40 becomes full, the sheet S can be removed utilizing the core shaft as a support.

Referring now to FIGS. 3 through 6D, the head driving mechanism provided in the processor 3U, in particular the head driving mechanism that drives two printing heads will be described in details.

Figure 3:
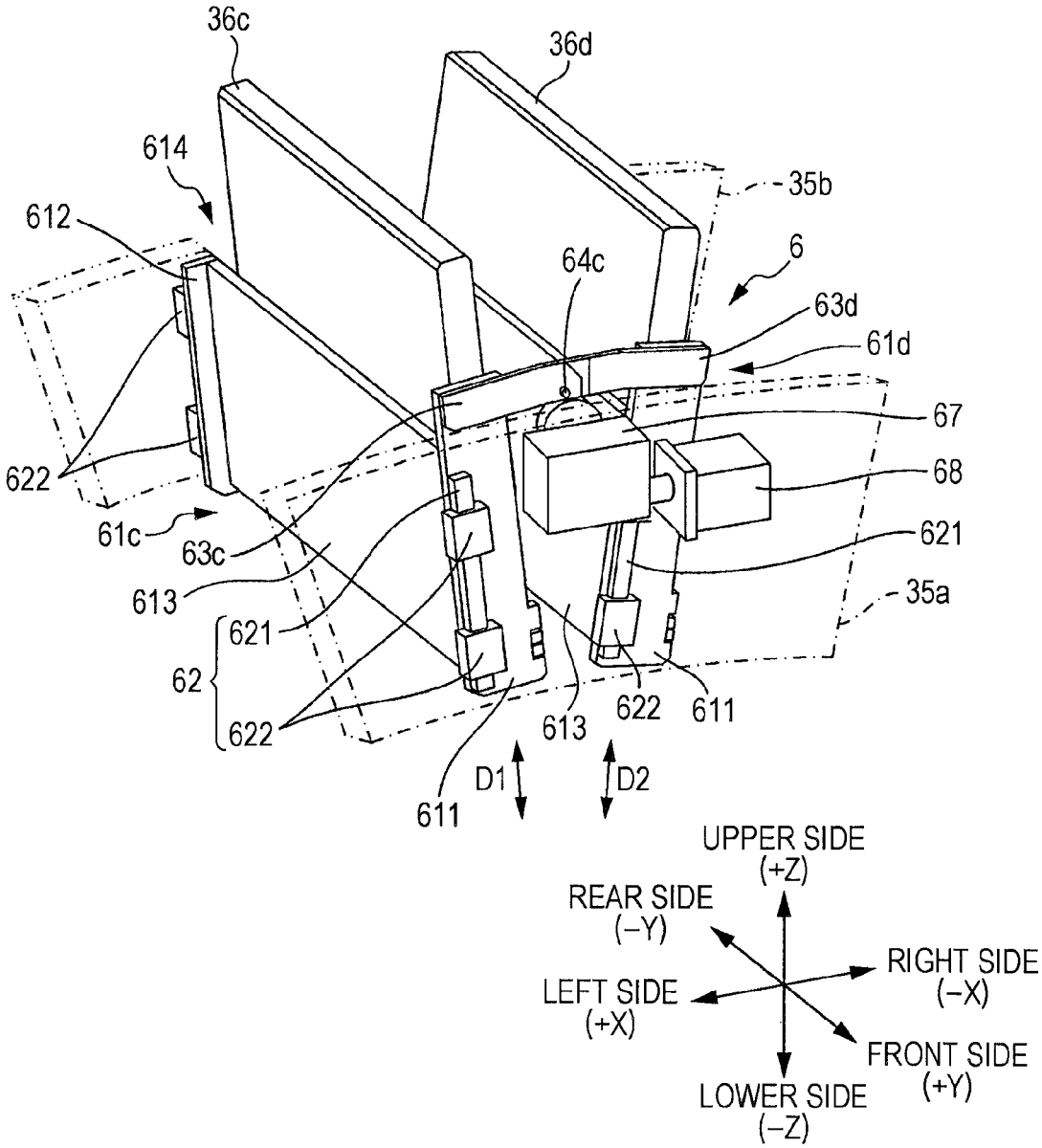
FIG. 3 is a perspective view showing a configuration of the head driving mechanism that moves printing heads to proper positions.
Figure 4:
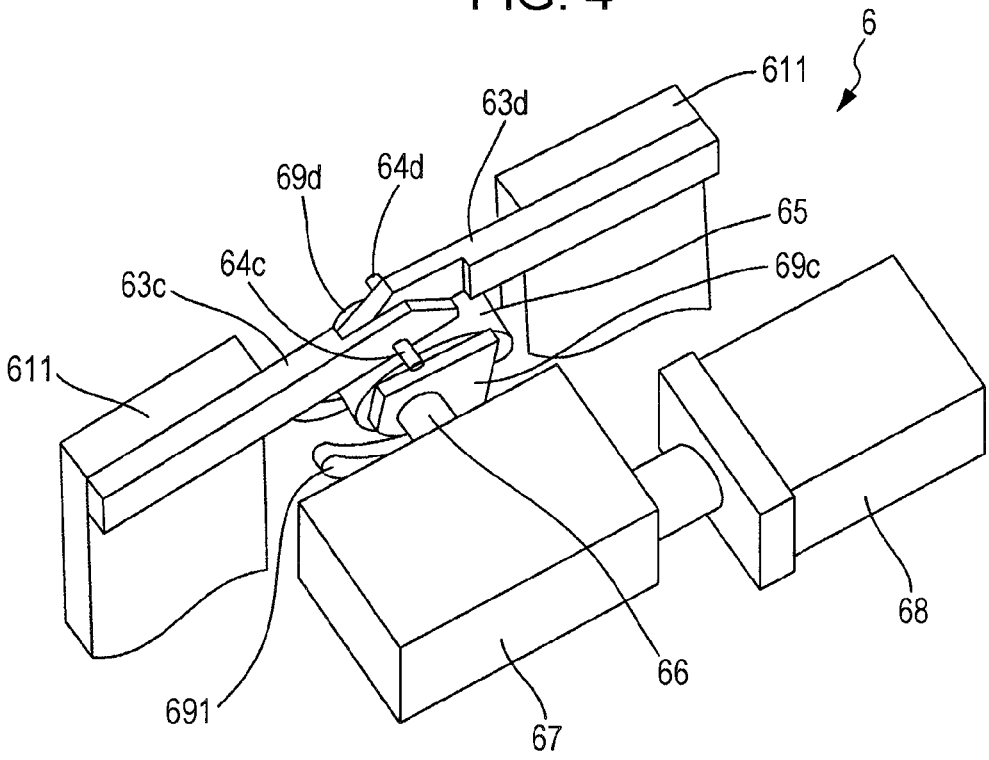
FIG. 4 is an enlarged perspective view showing a part of the head driving mechanism shown in FIG. 3.
Figure 5:
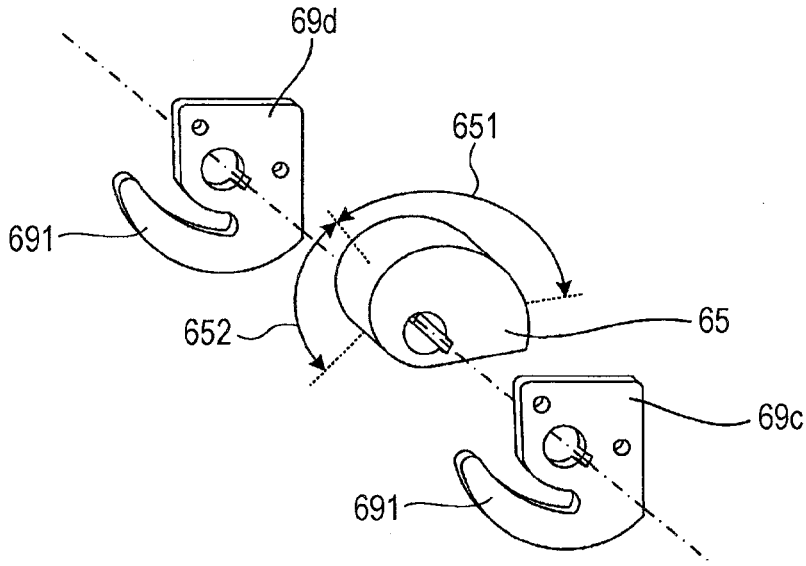
FIG. 5 is an exploded perspective view showing a cam and engaging members in the head driving mechanism shown in FIG. 3.

FIG. 3 is a perspective view showing a configuration of two printing heads and the head driving mechanism that moves the printing heads to proper positions. FIG. 4 is an enlarged perspective view showing a part of the head driving mechanism shown in FIG. 3. FIG. 5 is an exploded perspective view showing a cam and engaging members in the head driving mechanism shown in FIG. 3. FIGS. 6A to 6D are schematic front views showing operations of the head driving mechanism shown in FIG. 3. These drawings only show the head driving mechanism 6 that drives the printing heads 36*c*, 36*d*, and exclude the remaining portions. The configuration and operation of the head driving mechanism 6 will be described referring to the aforementioned drawings, and since another head driving mechanism that drives the printing heads 36*a*, 36*b* is configured in the same way, the description thereof will not be repeated.

The head driving mechanism 6 moves the printing head 36*c* in a first direction D1 to a proper position, the first direction D1 being perpendicular to the tangential line of the platen drum 30 at the position where the printing head 36*c* performs the printing (landing position of the magenta ink), in other words the radial direction from the rotation shaft 301 of the platen drum 30 that passes the landing position of the magenta ink. At the same time, the head driving mechanism 6 moves the printing head 36*d* in a second direction D2 to a proper position, the second direction D2 being perpendicular to the tangential line of the platen drum 30 at the position where the printing head 36*d* performs the printing (landing position of the black ink), in other words the radial direction from the rotation shaft 301 of the platen drum 30 that passes the landing position of the black ink. In this embodiment, accordingly, the moving directions D1, D2 of the printing heads 36*c*, 36*d* are inclined from each other by an angle θ (see FIG. 6A), and the head driving mechanism 6 is configured to move the printing heads 36*c*, 36*d* to the proper positions maintaining the angular relationship. The head driving mechanism 6 includes a holder 61*c* that retains the printing head 36*c*. The holder 61*c* includes a front holding member 611, a rear holding member 612, and a joint plate 613 that connects the holding members 611, 612. The printing head 36*c* can be removably inserted in the holder 61*c* from the (−Y) direction, through an opening 614 formed in the rear holding member 612.

A linear guide 62 extending in the first direction D1 is provided on the front face of the front holding member 611 and the rear face of the rear holding member 612, so as to allow the holder 61*c* to move in the first direction D1 with respect to the front plate 35*a* and the rear plate 35*b*. To be more detailed, as shown in FIG. 3, a linear rail 621 is fixed to the front face of the front holding member 611 so as to extend in the first direction D1, and a pair of sliders 622, 622 are attached along the rail 621 so as to slide in the first direction D1. The sliders 622, 622 are fixed to the rear face of the front plate 35*a*. Likewise, the linear guide 62 of the same shape as that on the front holding member 611 is attached to the rear face of the rear holding member 612, and the sliders 622, 622 that can slide along the linear guide 62 are fixed to the front face of the rear plate 35*b*. Providing thus the linear guide 62, 62 on the front and rear sides of the holder 61*c* enables the holder 61*c* to move in the first direction D1 with the printing head 36*c* retained therein.

The head driving mechanism 6 also includes a holder 61*d* that retains the printing head 36*d*, located downstream of the holder 61*c* in the transport direction Ds with a predetermined interval therefrom. The holder 61*d* includes, like the holder 61*c*, the front holding member 611, the rear holding member 612, and the joint plate 613, and the printing head 36*d* can be removably inserted in the holder 61*d* through the opening 614 formed in the rear holding member 612.

In addition, a linear guide 62 extending in the second direction D2 is provided on the front face of the front holding member 611 and the rear face of the rear holding member 612, so as to allow the holder 61*d* to move in the second direction D2 with respect to the front plate 35*a* and the rear plate 35*b*. The configuration of the linear guides 62 provided on the holder 61*d* is the same as those on the holder 61*c* except that the rails 621 extend in different directions. Therefore, the same numerals are adopted and detailed description will not be repeated.

A left cam follower 63*c*, having an end portion (left end portion) fixed to the front holding member 611 of the holder 61*c*, extends to the right toward the holder 61*d*, i.e., in the (−X) direction, so that the other end portion (right end portion) of the left cam follower 63*c* reaches the middle position between the respective front holding members 611 of the holders 61*c*, 61*d*. As shown in FIG. 4, the other end portion of the left cam follower 63*c* has the rear side cut away by half a thickness thereof to be formed into a thinner portion, and an engaging pin 64*c* projecting to the front side, i.e., in the (+Y) direction is provided on the thinner portion.

Likewise, a right cam follower 63*d*, having an end portion (right end portion) fixed to the front holding member 611 of the holder 61*d*, extends to the left toward the holder 61*c*, i.e., in the (+X) direction, so that the other end portion (left end portion) of the right cam follower 63*d* reaches the middle position between the respective front holding members 611 of the holders 61*c*, 61*d*. As shown in FIG. 4, the other end portion of the right cam follower 63*d* has the front side cut away by half a thickness thereof to be formed into a thinner portion, and an engaging pin 64*d* projecting to the rear side, i.e., in the (−Y) direction is provided on the thinner portion. Further, the thinner portions of the left and right cam followers 63*c*, 63*d* are disposed in sliding contact with each other at the middle position between the holders 61*c*, 61*d*, with the lower face of the other end portion of the left cam follower 63*c* and the lower face of the other end portion of the right cam follower 63*d* located adjacent to each other.

At the middle position between the holders 61*c*, 61*d*, further, a cam 65 is pivotally located at a predetermined position. The cam 65 is constantly located under the other end portions of the cam followers 63*c*, 63*d*, such that the outer circumferential surface of the cam 65 makes contact with the respective lower faces of the thinner portions of the cam followers 63*c*, 63*d* so as to support the other end portions of the cam followers 63*c*, 63*d*. The cam 65 is slightly thicker than the cam followers 63*c*, 63*d*, and attached to a cam shaft 66 extending in the front-back direction Y. The cam shaft 66 is connected to a rotary actuator 68 such as a motor through a power transmission unit 67, so that the rotative driving force generated by the rotary actuator 68 is transmitted to the cam shaft 66 through the power transmission unit 67. With such a configuration, the cam shaft 66 can rotate about its axial center, thereby causing the cam 65 to pivotally rotate.

Figure 6B:
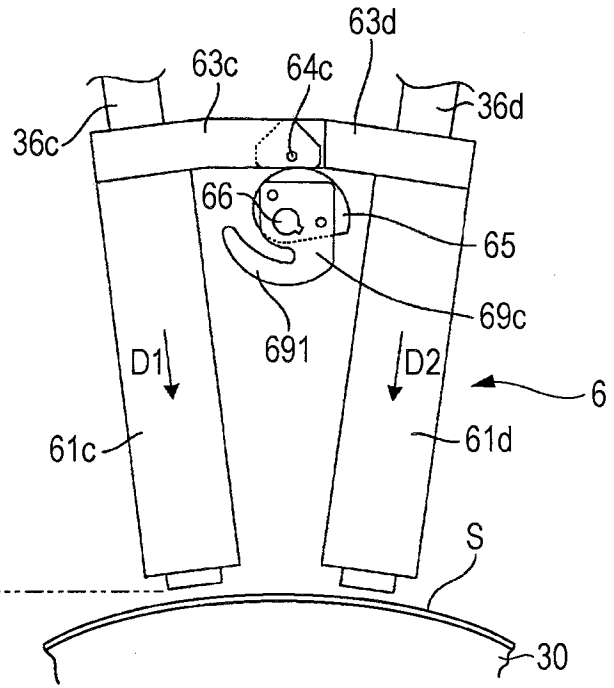
FIGS. 6A to 6D are schematic front views showing operations of the head driving mechanism shown in FIG. 3.
Figure 6A:
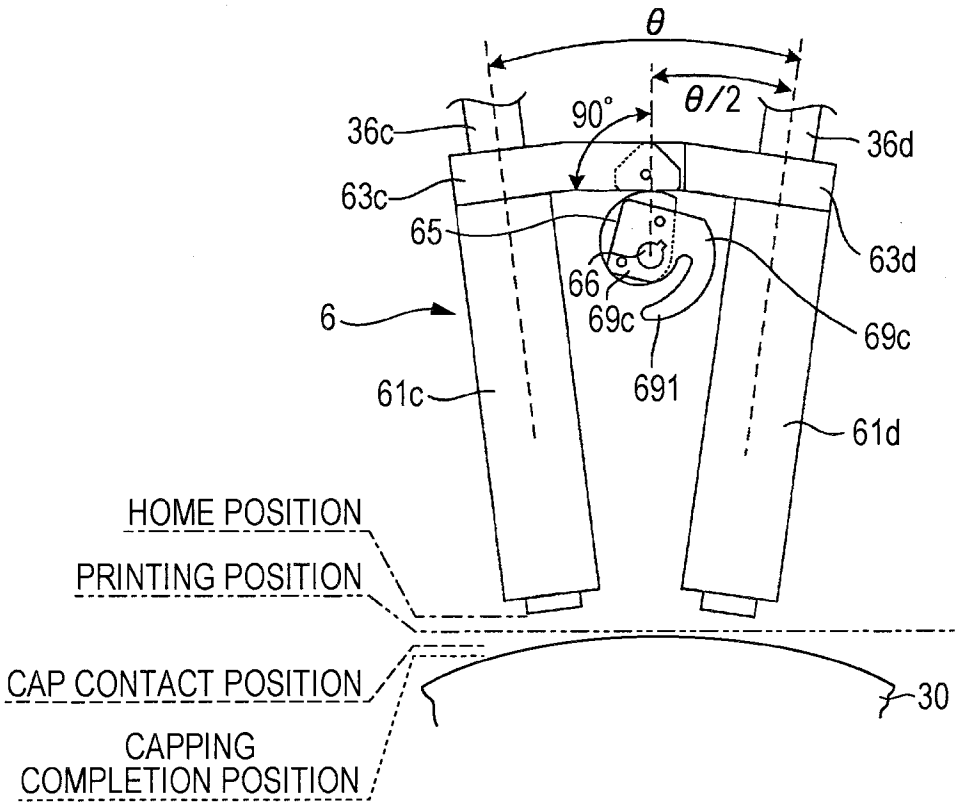

In this embodiment, the cam followers 63*c*, 63*d* are mildly bent at a central portion, such that the respective lower faces of the other end portions of the cam followers 63*c*, 63*d* become perpendicular to an imaginary line passing the cam shaft 66 and defining an angle of θ/2 with respect to the first direction D1 and the second direction D2, as shown in FIG. 6A. Such a configuration allows the lower faces of the cam followers 63*c*, 63*d* to be stably in contact with the cam 65 irrespective of the pivoting angle thereof, to thereby stably move the printing heads 36*c*, 36*d* toward and away from the platen drum 30, as will be subsequently described in further details.

Further, as shown in FIGS. 4 and 5, an engaging member 69*c* having a hook portion 691 that can be engaged with the engaging pin 64*c* is attached to the cam 65 and the cam shaft 66 on the front side (on the (+Y) side) of the cam 65, and an engaging member 69*d* having a hook portion 691 that can be engaged with the engaging pin 64*d* is attached to the cam 65 and the cam shaft 66 on the rear side (on the (−Y) side) of the cam 65. As will be described below in details, the outer circumferential surface of the cam 65 includes a printing adjustment region 651 that continuously varies the distance between the cam shaft 66 and the outer circumferential surface of the cam 65 so as to position the printing nozzle at the printing position, and a capping adjustment region 652 that continuously varies the distance between the cam shaft 66 and the outer circumferential surface of the cam 65 so as to position the printing nozzle at the capping position, the capping adjustment region 652 continuously extending from the printing adjustment region 651. In this embodiment, the distance between the cam shaft 66 and the outer circumferential surface of the cam 65 is varied by the printing adjustment region 651 in a pattern suitable for the printing operation, and by the capping adjustment region 652 in a pattern suitable for the capping operation, and the patterns are different from each other. When the capping adjustment region 652 makes contact with the respective lower faces of the other end portions of the cam followers 63*c*, 63*d*, the hook portions 691 reach a position above the cam 65 so as to be engaged with the engaging pins 64*c*, 64*d*. In other situations, the hook portions 691 are located at a position lower than the engaging pins 64*c*, 64*d*.

The operation of the thus-configured head driving mechanism 6 will be described in details referring to FIGS. 6A to 6D. In this embodiment, when neither the printing operation nor the maintenance operation is performed, an end portion of the printing adjustment region 651 of the cam 65 (farthest from the capping adjustment region 652) is located at the highest position in the vertical direction Z and in contact with the respective lower faces of the other end portions of the cam followers 63*c*, 63*d*. In this state, the printing heads 36*c*, 36*d* are positioned in a home position, at which the nozzle tips of the printing heads 36*c*, 36*d* are spaced from the platen drum 30 by a predetermined distance longer than the paper gap.

When the printing operation is to be performed on the sheet S having the respective end portions wound on the delivery unit 2 and the take-up unit 4 and being spanned therebetween, the rotary actuator 68 rotates by an amount corresponding to the thickness of the sheet S in accordance with an operation instruction from a control unit of the overall apparatus, to cause the cam 65 to rotate clockwise in FIG. 6A until the middle position of the printing adjustment region 651 of the cam 65 reaches the highest position in the vertical direction Z. In this embodiment, the cam followers 63*c*, 63*d* are located right on top of the cam 65 in the vertical direction Z, and hence pressed against the cam 65 by the self-weight. Accordingly, with the rotation of the cam 65, the cam followers 63*c*, 63*d* descend in the vertical direction Z at the same time and by the same distance, while the respective lower faces of the other end portions of the cam followers 63*c*, 63*d* make sliding contact with the outer circumferential surface of the cam 65. As a result, the holder 61*c* connected to the cam follower 63*c* descends in the first direction D1, so that the printing head 36*c* retained by the holder 61*c* is positioned at the printing position determined according to the thickness of the sheet S. Thus, the distance between the nozzle tip of the printing head 36*c* and the sheet S is adjusted to the desired paper gap.

At the same time as the positioning of the printing head 36*c*, the positioning of the printing head 36*d* is also performed. To be more detailed, the holder 61*d* connected to the cam follower 63*d* descends in the second direction D2, so that the printing head 36*d* retained by the holder 61*d* is positioned at the printing position, and the distance between the nozzle tip of the printing head 36*d* and the sheet S is adjusted to the desired paper gap. Since the distance between the cam shaft 66 and the outer circumferential surface of the cam 65 is continuously varied by the printing adjustment region 651 in this embodiment, the printing heads 36*c*, 36*d* can be positioned with high accuracy by controlling the rotational angle of the cam 65, and thus the desired paper gap can be securely achieved.

The printing heads 36*a*, 36*b* can also be properly positioned as the printing heads 36*c*, 36*d*, by the head driving mechanism having the same configuration as that of the head driving mechanism 6. The remaining printing head 36*e* is positioned by still another head driving mechanism.

Figure 6D:
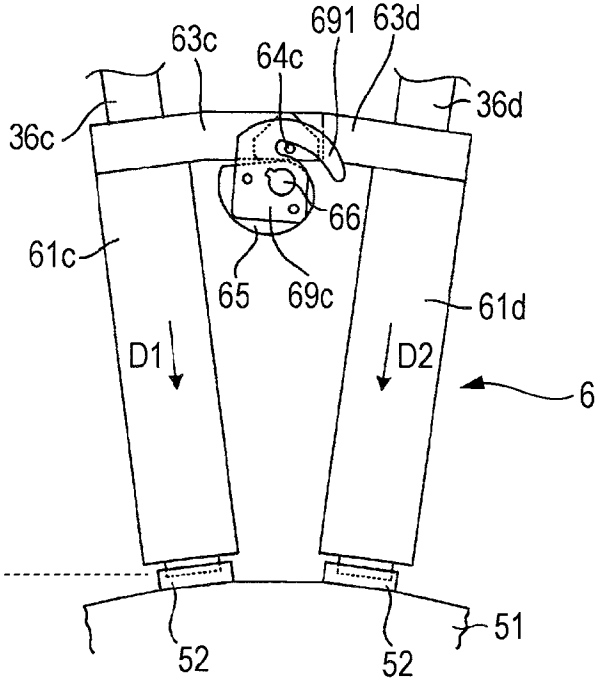
Figure 6C:
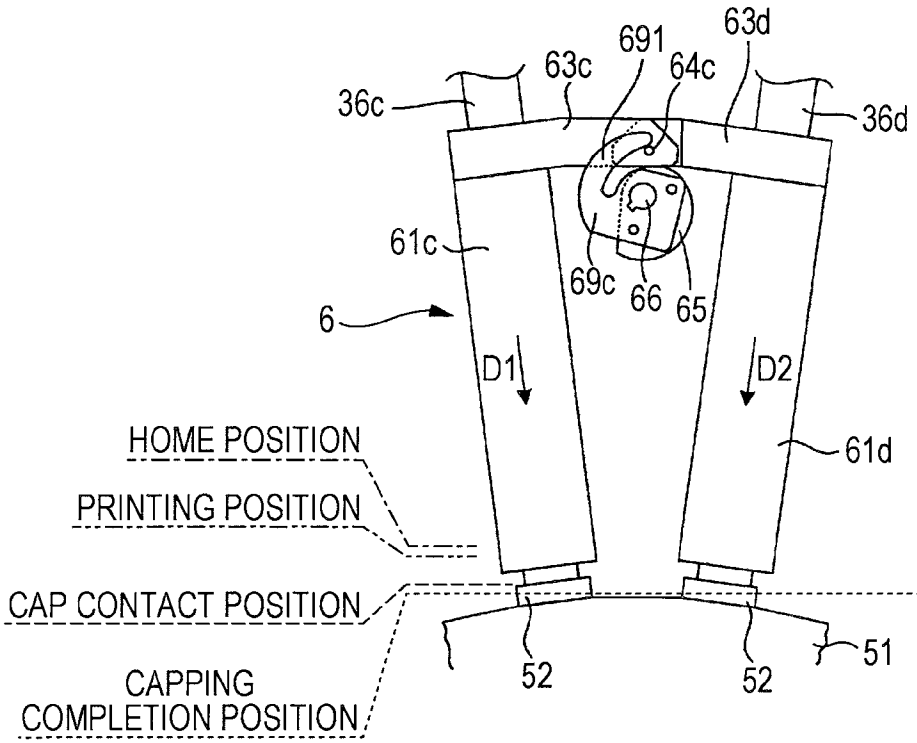

Upon completing the setting as above the printing operation is performed, during or after which the maintenance of the processor 3U has to be performed, according to the operation status of the apparatus. In the maintenance operation, the processor 3U is moved backward, i.e., in the (−Y) direction as a whole, and undergoes various maintenance works in the maintenance unit 5. The maintenance works include the capping operation for the printing heads 36*a* to 36*e*. The capping operation serves to prevent clogging of the nozzles of the printing heads 36*a* to 36*e*, and the maintenance unit 5 includes a capping mechanism 51 that performs the capping operation as shown in FIGS. 6C and 6D. The capping operation is performed as described below, for the processor 3U moved to the maintenance unit 5.

The capping mechanism 51 includes cap portions 52 respectively located at fixed positions so as to correspond to the printing heads 36*a* to 36*e*. When the processor 3U is moved to the capping mechanism 51, the printing heads 36*a* to 36*e* are located above the corresponding cap portions 52 in the vertical direction Z. Although only the printing heads 36*c*, 36*d* are shown in FIGS. 6C and 6D as for the printing operation, the remaining printing heads also operate basically in the same way.

When the printing heads 36*c*, 36*d* are set to correspond to the cap portions 52, 52, the rotary actuator 68 rotates in accordance with an operation instruction from the control unit, to cause the cam 65 to rotate clockwise in FIG. 6C until the boundary between the printing adjustment region 651 and the capping adjustment region 652 of the cam 65 reaches the highest position in the vertical direction Z. With the rotation of the cam 65, the cam followers 63*c*, 63*d* descend in the vertical direction Z at the same time and by the same distance, and the holders 61*c*, 61*d* connected to the cam followers 63*c*, 63*d* respectively descend in the first direction D1 and the second direction D2. As a result, the printing heads 36*c*, 36*d* are set at the position where the respective nozzle tips make contact with the corresponding cap portions 52.

In addition, with the rotation of the cam 65 the engaging members 69*c*, 69*d* attached to the cam 65 and the cam shaft 66 also rotate clockwise in FIG. 6C. Then the hook portion 691 of the engaging member 69*c* starts to be engaged with the engaging pin 64*c* projecting from the cam follower 63*c*. Likewise, although not illustrated in FIG. 6C, the hook portion 691 of the engaging member 69*d* starts to be engaged with the engaging pin 64*d* projecting from the cam follower 63*d*. In this embodiment, the distance between the capping adjustment region 652 of the cam 65 and the hook portion 691 is generally constant over the entirety of the capping adjustment region 652, and is slightly larger than the diameter of the engaging pins 64*c*, 64*d*. Accordingly, the engaging pins 64*c*, 64*d* are located between the outer circumferential surface of the cam 65 and the hook portion 691 with a certain play.

Thereafter, the rotary actuator 68 further rotates according to an operation instruction from the control unit, to cause the cam 65 to rotate clockwise in FIG. 6C until the middle position of the capping adjustment region 652 of the cam 65 reaches the highest position in the vertical direction Z. During such rotation also, the engaging pins 64*c*, 64*d* are located between the outer circumferential surface of the cam 65 and the hook portion 691, and the cam followers 63*c*, 63*d* descend in the vertical direction Z at the same time and by the same distance resisting the pressure applied by the cap portions 52, so that the holders 61*c*, 61*d* connected to the cam followers 63*c*, 63*d* respectively move in the first direction D1 and the second direction D2. As a result, the printing heads 36*c*, 36*d* are respectively pressed against the cap portions 52, 52 and the capping operation is performed.

Upon completing the capping operation, the rotary actuator 68 rotates in the reverse direction according to an operation instruction from the control unit, causing the printing heads 36*c*, 36*d* to ascend. Then the processor 3U is returned to the processing unit 3, after undergoing various maintenance works in the maintenance unit 5.

In this embodiment, as described above, the printing heads 36*a* to 36*e* are radially located about the rotation shaft 301 of the platen drum 30. In other words, the dispensing direction of the ink is perpendicular to the surface platen drum 30, at the respective positions where the ink dispensed from the printing heads 36*a* to 36*e* lands on the sheet S wound on the platen drum 30. Out of these printing heads, the printing heads 36*c*, 36*d* are positioned by the single cam 65, and the distance between the printing head and the recording medium, i.e., the paper gap, is adjusted. Such a configuration prevents the paper gap from being adjusted to different values between the printing heads 36*c*, 36*d*. Further, the printing heads 36*a*, 36*b* are configured in the same way as the printing heads 36*c*, 36*d*. Consequently, a highly accurate printing result can be obtained.

In addition, the two printing heads 36*c*, 36*d* set to move in different directions are driven by the single head driving mechanism 6. This is also the case with the printing heads 36*a*, 36*b*. Such a configuration contributes to reducing the size and the manufacturing cost of the printing apparatus, compared with the configuration in which the head driving mechanisms are provided for the respective printing heads.

Further, the single cam 65 drives the both printing heads 36*c*, 36*d*, in other words the cam 65 is utilized in common by the printing heads 36*c*, 36*d*. Therefore, the printing heads 36*c*, 36*d* can be properly positioned free from the influence of the individual variation between the cams. In this aspect also, the printing heads 36*a*, 36*b* are configured in the same way as the printing heads 36*c*, 36*d*. Consequently, a highly accurate printing result can be obtained.

Further, the outer circumferential surface of the cam 65 includes two adjustment regions, namely the printing adjustment region 651 and the capping adjustment region 652, so as to move the printing heads 36*a* to 36*d* in the patterns suitable for the printing operation and the tapping operation.

Still further, in the foregoing embodiment the cam followers 63*c*, 63*d* respectively include the engaging pins 64*c*, 64*d*, and also the engaging members 69*c*, 69*d* that can be respectively engaged with the engaging pins 64*c*, 64*d* are provided, so that the engaging members 69*c*, 69*d* are engaged with the engaging pins 64*c*, 64*d* in the capping operation. Such a configuration enables the printing heads 36*c*, 36*d* to be pressed against the cap portions 52, 52, thus assuring that the capping operation is properly performed.

In the foregoing embodiment, the platen drum 30 corresponds to the "roller" according to the present invention. The printing heads 36*c*, 36*d* respectively correspond to the "first printing head" and the "second printing head" and the holders 61*c*, 61*d* respectively correspond to the "first holding unit" and the "second holding unit" according to the present invention. The cam follower 63*c* corresponds to the "first cam follower" according to the present invention, and the lower face of the other end portion of the cam follower 63*c* corresponds to the "first sliding-contact surface" according to the present invention. Likewise, the cam follower 63*d* corresponds to the "second cam follower" according to the present invention, and the lower face of the other end portion of the cam follower 63*d* corresponds to the "second sliding-contact surface" according to the present invention. In the outer circumferential surface of the cam 65, the printing adjustment region 651 corresponds to the "first adjustment region" and the capping adjustment region 652 corresponds to the "second adjustment region" according to the present invention. Further, the engaging members 69*c*, 69*d* respectively correspond to the "first restriction member" and the "second restriction member" according to the present invention.

It is to be noted that the present invention is in no way limited to the foregoing embodiment, but may be modified in various manners within the scope of the present invention. For example, although the head driving mechanism 6 is configured to drive two printing heads at a time in the embodiment, the head driving mechanism 6 may be configured to drive three or more printing heads at a time.

Although the rotative driving force generated by the rotary actuator 68 is applied to the cam shaft 66 through the power transmission unit 67 in the embodiment, the rotary actuator 68 may directly apply the driving force to the cam shaft 66.

Further, although the engaging pins 64*c*, 64*d* are respectively attached to the cam followers 63*c*, 63*d* for the hook portions 691 to be engaged therewith in the embodiment, a part of the cam followers 63*c*, 63*d* may be formed in a projecting shape, and such projections may be employed as the first engaging portion and the second engaging portion according to the present invention. Although the engaging members 69*c*, 69*d* are attached to the cam 65 and the cam shaft 66 in the embodiment, the engaging members may be attached only one of the cam 65 and the cam shaft 66, provided that the engaging members can be made to rotate together with the cam 65, by the rotation of the cam shaft 66.

Still further, although the present invention is applied to the head driving mechanism that drives a plurality of printing heads that dispense UV ink in the foregoing embodiment, the present invention is applicable to various different head driving mechanisms.

What is claimed is:

1. A head moving mechanism comprising:

a first holding unit that holds a first printing head so as to move together with the first printing head in a first direction;

a second holding unit that holds a second printing head so as to move together with the second printing head in a second direction inclined with respect to the first direction;

a rotary actuator that generates rotative driving force for moving the first printing head and the second printing head;

a cam shaft to be driven to rotate by the rotative driving force from the rotary actuator;

a cam attached to the cam shaft;

a first cam follower a first end portion of which is attached to the first holding unit and a second end portion of which includes a first sliding-contact surface disposed in sliding contact with the cam; and a second cam follower a third end portion of which is attached to the second holding unit and a fourth end portion of which includes a second sliding-contact surface disposed in sliding contact with the cam, the first cam follower and the second cam follower being each displaced by rotation of the cam so as to move the first holding unit together with the first printing head and move the second holding unit together with the second printing head, while the first sliding-contact surface and the second sliding-contact surface are in sliding contact with an outer circumferential surface of the cam.

2. The head moving mechanism according to claim 1, wherein the first sliding-contact surface and the second sliding-contact surface are oriented downward in a vertical direction, and disposed in contact with an outer circumferential surface of the cam.

3. The head moving mechanism according to claim 2, wherein the outer circumferential surface of the cam includes:

a first adjustment region that varies a distance between the cam shaft and the outer circumferential surface in a first variation pattern; and a second adjustment region that varies the distance between the cam shaft and the outer circumferential surface in a second variation pattern, the second adjustment region continuously extending from the first adjustment region, the first printing head and the second printing head are positioned in a vertical direction on the basis of the first variation pattern, while the first sliding-contact surface and the second sliding-contact surface are in sliding contact with the first adjustment region to rotate the cam, and the first printing head and the second printing head are positioned in a vertical direction on the basis of the second variation pattern, while the first sliding-contact surface and the second sliding-contact surface are in sliding contact with the second adjustment region to rotate the cam.

4. The head moving mechanism according to claim 3, further comprising:

a first engaging portion provided on the other end portion of the first cam follower;

a second engaging portion provided on the other end portion of the second cam follower;

a first restriction member having an end portion attached to the cam shaft or the cam to rotate with the cam in an interlocked manner and the other end portion to be located above the second adjustment region in the vertical direction so as to hold the first engaging portion between the second adjustment region and the first restriction member to restrict the first cam follower from moving in the vertical direction, while the second adjustment region of the cam is in sliding contact with the first sliding-contact surface; and a second restriction member having an end portion attached to the cam shaft or the cam to rotate with the cam in an interlocked manner and the other end portion to be located above the second adjustment region in the vertical direction so as to hold the second engaging portion between the second adjustment region and the second restriction member to restrict the second cam follower from moving in the vertical direction, while the second adjustment region of the cam is in sliding contact with the second sliding-contact surface.

5. The head moving mechanism according to claim 1, wherein the first cam follower extends in a third direction intersecting the first direction and a shaft direction of the cam shaft, the first end portion and the second end portion are opposite each other in the third direction, the second cam follower extends in a fourth direction intersecting the second direction and the shaft direction, the third end portion and the fourth end portion are opposite each other in the fourth direction, and the second portion of the first cam follower and the fourth end portion of the second cam follower slidably contact each other.

6. The head moving mechanism according to claim 5, wherein the first end portion has a first width in the shaft direction, the second end portion has a second width in the shaft direction, which is smaller than the first width.

7. The head moving mechanism according to claim 5, wherein the third end portion has a third width in the shaft direction, the fourth end portion has a fourth width in the shaft direction, which is smaller than the third width.

8. The head moving mechanism according to claim 5, wherein the second end portion has a second width in the shaft direction, the fourth end portion has a fourth width in the shaft direction, and the cam shaft has a fifth width in the shaft direction, which is larger than a total width of the second width and the fourth width.

9. A printing apparatus comprising:

a rotatable roller;

a first printing head that dispenses a first liquid in a first direction onto a recording medium wound around a surface of the roller;

a second printing head that dispenses a second liquid in a second direction inclined with respect to the first direction onto the recording medium wound around the surface of the roller; and a head moving mechanism that drives the first printing head and the second printing head, the head moving mechanism including a first holding unit that holds the first printing head so as to move together with the first printing head in the first direction;

a second holding unit that holds the second printing head so as to move together with the second printing head in the second direction;

a rotary actuator that generates rotative driving force for moving the first printing head and the second printing head;

a cam shaft to be driven to rotate by the rotative driving force from the rotary actuator;

a cam attached to the cam shaft;

a first cam follower an end portion of which is attached to the first holding unit and the other end portion of which includes a first sliding-contact surface disposed in sliding contact with the cam; and a second cam follower an end portion of which is attached to the second holding unit and the other end portion of which includes a second sliding-contact surface disposed in sliding contact with the cam, the first cam follower and the second cam follower being each displaced by rotation of the cam so as to move the first holding unit together with the first printing head and move the second holding unit together with the second printing head, while the first sliding-contact surface and the second sliding-contact surface are located adjacent to each other and simultaneously in sliding contact with an outer circumferential surface of the cam.

10. The printing apparatus according to claim 9, wherein the first direction and the second direction radially extend from the rotation axis of the roller.

* * * * *